US006713438B1

(12) United States Patent
Baillargeon et al.

(10) Patent No.: US 6,713,438 B1
(45) Date of Patent: Mar. 30, 2004

(54) HIGH PERFORMANCE ENGINE OIL

(75) Inventors: David J. Baillargeon, Cherry Hill, NJ (US); Raymond J. Bergstra, Ashburn, VA (US); Andrew Jackson, Pennington, NJ (US); William L. Maxwell, Pilesgrove, NJ (US); G. James Johnston, Hamburg (DE); Robert A. Pache, Milltown, NJ (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/275,664

(22) Filed: Mar. 24, 1999

(51) Int. Cl.[7] ..... C10M 105/00

(52) U.S. Cl. ..... 508/463; 508/485; 508/492; 508/496; 508/499; 508/591; 208/18; 208/19; 208/20; 208/21; 585/9; 585/10; 585/11; 585/12; 585/13

(58) Field of Search ..... 508/485, 492, 508/591, 496, 463, 499; 585/9, 10, 11–13, 25; 208/18–21

(56) References Cited

U.S. PATENT DOCUMENTS

| | | | | | |
|---|---|---|---|---|---|
| 4,620,048 | A | | 10/1986 | Ver Strate et al. | 585/10 |
| 4,827,064 | A | | 5/1989 | Wu | 585/10 |
| 4,827,073 | A | | 5/1989 | Wu | 585/530 |
| 4,906,799 | A | * | 3/1990 | Forbus, Jr. et al. | 585/241 |
| 4,912,272 | A | * | 3/1990 | Wu | 585/10 |
| 4,943,383 | A | * | 7/1990 | Avery et al. | |
| 4,956,122 | A | | 9/1990 | Watts et al. | 252/565 |
| 5,012,020 | A | * | 4/1991 | Jackson et al. | 585/10 |
| 5,057,235 | A | * | 10/1991 | Farng et al. | |
| 5,104,579 | A | * | 4/1992 | Benjamin et al. | |
| 5,132,478 | A | * | 7/1992 | Ho et al. | 585/467 |
| 5,146,021 | A | | 9/1992 | Jackson et al. | 585/10 |
| 5,157,177 | A | * | 10/1992 | Pelrine et al. | 585/10 |
| 5,208,403 | A | * | 5/1993 | Buchanan et al. | 585/10 |
| 5,243,114 | A | * | 9/1993 | Johnson et al. | 583/329 |
| 5,254,274 | A | * | 10/1993 | Ho et al. | |
| 5,276,227 | A | * | 1/1994 | Wu et al. | 585/12 |
| 5,276,229 | A | * | 1/1994 | Buchanan et al. | 585/255 |
| 5,329,055 | A | | 7/1994 | Bachman et al. | 585/12 |
| 5,602,086 | A | * | 2/1997 | Le et al. | 508/591 |
| 5,693,598 | A | | 12/1997 | Abraham et al. | 508/444 |
| 5,763,369 | A | | 6/1998 | Baumgart et al. | 508/183 |
| 5,814,586 | A | | 9/1998 | Boden et al. | 508/221 |

OTHER PUBLICATIONS

Cameron A., J. Inst. Petrol. Tech. 40, 191 (1954) month unavailable.
Okrent, E.H., ASLE Trans. 4, 97 (1961) month unavailable.
Tanner, R. I., ASLE Trans. 8, 179 (1965) month unavailable.
Davies et al The Rheology of Lubricants, John Wiley, NY 1973, p. 65 month unavailable.
Ballal et al., Trans. Soc. Rheol. 20, 65 (1976) month available.

* cited by examiner

*Primary Examiner*—Margaret Medley
(74) *Attorney, Agent, or Firm*—Malcolm D. Keen

(57) ABSTRACT

High performance engine oils and other liquid lubricants comprise a liquid lubricant basestock of low viscosity from 1.5 to 12 cSt (100C) with two dissolved polymer components of differing molecular weights. The basestock is preferably a single PAO or blend of PAOs with a co-basestock component which is preferably an ester or an alkylated aromatic of comparable viscosity. The lower molecular weight polymer is highly viscoelastic in character and is preferably an HVI-PAO; this component in the lubricant which provides unexpectedly high film thickness and unexpectedly good wear protection under conditions where the second, higher molecular weight polymer may lose some or all of its thickening power. The use of the highly viscoelastic low molecular weight polymer in combination with the higher molecular weight thickener enables the production of very widely cross-graded engine oils, especially oils with a low temperature grading of 0W or better. Oils with cross gradings of 0W20, 0W30, 0W40 or even more widely cross graded, for example 0W70 or higher may be achieved.

41 Claims, 1 Drawing Sheet

HIGH PERFORMANCE ENGINE OIL

FIELD OF THE INVENTION

Figure 1:
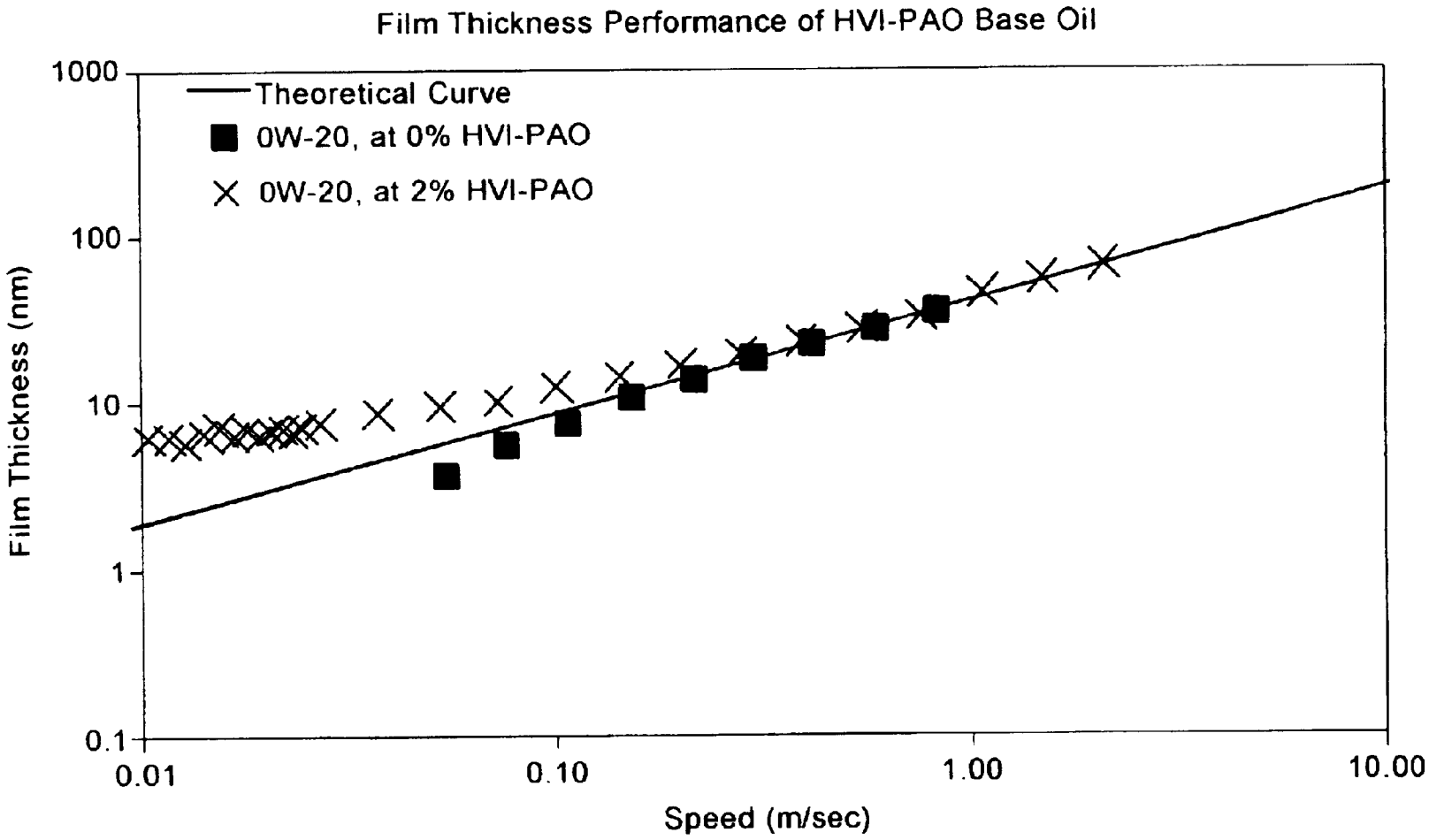

This invention relates to engine oils useful in internal combustion engines and more particularly to engine oils having good antiwear and viscometric properties as well as other desirable properties including resistance to oxidation under conditions of high temperature, high speed and high load. The preferred engines oils of this type are synthetic oils but the advantages of the invention may be extended to oils containing base stocks of mineral origin.

BACKGROUND OF THE INVENTION

Multi-grade engine oils, derived from a combination of low viscosity basestocks and high molecular weight thickeners, viscosity index improvers, and other components have been used for a long time. Synthetic engine oils based on polyalphaolefins (PAOs) have been shown to demonstrate performance benefits together with cost effectiveness in automotive and other engine applications. In these synthetic oils, as with conventional oils of mineral origin, the viscosity-temperature relationship of the oil is one of the critical criteria which must be considered when selecting the lubricant for a particular application. The viscosity requirements for qualifications as multi-grade engine oils are described by the SAE Engine Oil Viscosity Classification-SAE J300. The low temperature (WA) viscosity requirements are determined by ASTM D 5293, Method of Test for Apparent Viscosity of Motor Oils at Low Temperature Using the Cold Cranking Simulator (CCS), and the results are reported in centipoise (cP). The higher temperature (100° C.) viscosity is measured according to ASTM D445, Method of Test for kinematic Viscosity of Transparent and Opaque Liquids, and the results are reported incentistokes (cSt). Table 1 below outlines the high and low temperature requirements for the recognized SAE grades for engine oils.

TABLE 1

Engine Oil Viscosity Grade Specifications (SAE J300)

| SAE Viscosity | Cranking Viscosity (cP) at Temperature (° C.) | Kinematic Viscosity (cSt.) at 100 ° C. | |
|---|---|---|---|
| Grade | Max. | Min. | Max. |
| 0 W | 3250 at −30° | 3.8 | |
| 5 W | 3500 at −25° | 3.8 | |
| 10 W | 3500 at −20° | 4.1 | |
| 15 W | 3500 at −15° | 5.6 | |
| 20 W | 4500 at −10° | 5.6 | |
| 25 W | 6000 at −5° | 9.3 | |
| 20 | | 5.6 | <9.3 |
| 30 | | 9.3 | <12.5 |
| 40 | | 12.5 | <16.3 |
| 50 | | 16.3 | <21.9 |
| 60 | | 21.9 | <26.1 |

The SAE J300 viscosity grade definitions end at SAE 60 but the scale may be extrapolated in a simple linear manner using the following correlation, which is used in this specification in reference to viscosity grades beyond J300:

TABLE 1a

Extended High-Temperature Viscosity Grades

| Viscosity Grade | Kinematic Viscosity (cSt) Minimum | Kinematic Viscosity (cSt) Maximum |
|---|---|---|
| | (Extrapolation beyond SAE J300) | |
| 70 | 26.1 | <30 |
| 80 | 30 | <35 |
| 90 | 35 | <40 |
| 100 | 40 | <45 |
| 110 | 45 | <50 |
| 120 | 50 | <55 |
| 130 | 55 | <60 |
| 140 | 60 | <65 |
| 150 | 65 | <70 |

In a similar manner, SAE J306c describes the viscometric qualifications for axle and manual transmission lubricants. High temperature (100° C.) viscosity measurements are performed according to ASTM D445. The low temperature viscosity values are determined according to ASTM D2983, Method of Test for Apparent Viscosity at Low Temperature Using the Brookfield Viscometer and these results are reported in centipoise (cP). Table 2 summarizes the high and low temperature requirements for qualification of axle and manual transmission lubricants.

TABLE 2

Axle/Transmission Oil Viscosity Specifications

| SAE Viscosity | Maximum Temperature for Viscosity | Kinematic Viscosity at 100 ° C., cSt. | |
|---|---|---|---|
| Grade | of 150,000 cP., ° C. | Min | Max |
| 70 W | −55 | — | |
| 75 W | −40 | 4.1 | |
| 80 W | −26 | 7.0 | |
| 85 W | −12 | 11.0 | |
| 90 | — | 13.5 | <24.0 |
| 140 | — | 24.0 | <41.0 |
| 250 | — | | |

In addition to the viscosity temperature relationship, other properties are, of course, required for an engine oil including resistance to oxidation under the high temperatures encountered in the engine, resistance to hydrolysis in the presence of the water produced as a combustion product (which may enter the lubricating circulation system as a result of ring blow-by) and since the finished oil is a combination of basestock together with additives, these properties should be achieved in the final, finished lubricant so that it possesses the desired balance of properties over its useful life In recent years, considerable attention has been given to the tribological behavior of lubricants under conditions of high shear rate and high pressure. At high shear rates, as in a lubrication contact zone, considerable shear thinning may occur, which results in a decrease in the thickness of the lubricant film separating the relatively moving surfaces with the possibility that inadequate film thickness may be maintained under these conditions. As a counter to this tendency, it would be desirable to provide lubricant compositions which can function effectively under high temperature conditions and which possess good Theological properties to provide adequate. film thickness and wear protection by resisting shear thinning under conditions of high temperature and high shear rate as well as high contact pressure.

As noted above, various combinations of additives with lubricants have been used in the past for the improvement of lubricant properties and in particular, the use of polymeric materials for altering the viscosity or viscosity index of base stocks of mineral and synthetic origin has been well known for a number of years. Polymeric thickeners which are commonly used in the production of multi-grade lubricants typically include hydrogenated styrene-isoprene block copolymers, rubbers based on ethylene and propylene (OCP), polymers produced by polymerization of esters of the acrylate or methacrylate series, polyisobutylene and the like. These polymeric thickeners are added to bring the viscosity of the base fluid up to the level required for the desired grade (high temperature specification) and possibly to increase the viscosity index of the fluid, allowing for the production of multi-grade oils.

The use of high molecular weight thickeners and VI improvers in the production of multi-grade lubricants has, however, some serious drawbacks. First, these improvements are more sensitive to oxidation than the basestocks in which they are used, which may result in a progressive loss of viscosity index and thickening power with use and frequently in the formation of unwanted deposits. In addition, these materials tend to be sensitive to high shear rates and stresses as well as to a high degree of temporary shear the result of which is that temporary or permanent viscosity losses, or reduction of film thickness in bearings may occur. Temporary viscosity losses occurring from shear forces are the result of the non-Newtonian viscometrics associated with the solutions of high molecular weight polymers. As the polymer chains align with the shear field under high shear rates, a decrease in viscosity occurs, reducing film thickness and the wear protection associated with the elastohydrodynamic film. By contrast, Newtonian fluids maintain their viscosity regardless of shear rate. From the point of view of lubricant performance at high temperatures and under the influence of a shear rate condition, it would be desirable to maintain Newtonian rheological properties for the lubricant.

U.S. Pat. No. 4,956,122 (Watts/Uniroyal) discloses lubricating compositions based on combination of low and high molecular weight PAOs which are stated to provide high viscosity index coupled with improved resistance to oxidative degradation and resistance to viscosity losses caused by permanent or temporary shear conditions. According to the invention description in this patent, the lubricating composition comprises a high viscosity PAO or other synthetic hydrocarbon together with a low viscosity mineral derived oil or PAO or other synthetic hydrocarbon such as alkyl benzene. Optionally, a low viscosity ester and an additive package may be included in the lubricants. While the combination of PAO components of varying molecular weight has been effective in a variety of different applications, further improvements in reducing shear thinning characteristics would be desirable, particularly with increasing demands on engine oil performance. Under modern engine manufacturing trends, engines are operating at higher temperatures and as bearing loadings increase as a result of increased specific power output (kW/I), shear thinning conditions are greatly aggravated.

A new type of PAO lubricant was introduced by U.S. Pat. Nos. 4,827,064 and 4,827,073 (Wu). These PAO materials, which are produced by the use of a reduced valence state chromium catalyst, are olefin oligomers or polymers which are characterized by very high viscosity indices which give them very desirable properties to be useful as lubricant basestocks and, with higher viscosity grades; as VI improvers. They are referred to as High Viscosity Index PAOs or HVI-PAOs. The relatively low molecular weight HVI-PAO materials were found to be useful as lubricant basestocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived basestocks.

We have now found that it is possible to use the HVI-PAO oligomers in combination with oils or mineral origin as well as PAO and other synthetic basestocks in combination with high molecular weight polymers such as viscosity modifiers and VI improvers to produce lubricants which are characterized by viscosity thickening properties. Under high shear rate conditions, as in a highly loaded lubrication contact zone, the good viscoelastic properties of the HVI-PAO component produces unexpectedly high film thickness. The improved film thickness provides an unexpected degree of wear protection, resisting shear thinning under conditions where high molecular weight polymers lose some or all of their thickening power. Under low-shear or no-shear conditions, as in low pressure oil circulating systems, the high molecular weight polymer which is used in addition to the low molecular weight viscoelastic polymer, provides enhanced bulk oil viscosity due to its thickening properties under conditions where the low molecular weight polymers have little or no thickening power. Multi-grade and widely cross-graded oils can therefore be produced with a combination of good performance properties which are maintained under varying conditions, but are especially notable under conditions of high temperature high shear rate where they provide unexpectedly good wear protection.

SUMMARY OF THE INVENTION

The high performance liquid lubricants of the present invention comprise a first polymer and a second polymer of differing molecular weights dissolved in a liquid lubricant basestock of low viscosity. The first polymer, which is of lower molecular weight than the second polymer, possesses high viscoelastic properties as indicated by its unexpectedly high first normal stress difference. This polymer component in the lubricant provides unexpectedly high film thickness and unexpectedly good wear protection under conditions where high molecular weight polymers lose some or all of their thickening power, for example, at high shear rates in lubrication contact zones. The second polymer, which has a higher molecular weight than the first polymer, is characterized by viscosity thickening properties when blended with the liquid basestock used in the lubricant, which may be either mineral-oil derived or synthetic, preferably a PAO.

In preferred compositions of this type, the basestock is typically a wholly synthetic base oil which may be a single PAO or blend of PAOs which provides the designed viscosity in the final blend, together with the other components including the highly viscoelastic polymer which is preferably one of the HVI-PAO olefin polymers referred to above.

The highly viscoelastic component will have a viscosity which is greater than that of the PAO basestock but less than that of the higher molecular weight polymer which is typically one of the polymeric thickeners such as the hydrogenated styrene-isoprene block copolymers, ethylene/propylene rubbers, polyisobutylenes or similar materials referred to above. This polymeric component will typically have a molecular weight in the range from 10,000 to 1,000,000, more usually of at least 100,000.

The use of the highly viscoelastic low molecular weight polymer enables the production of very widely cross-graded engine oils, especially oils with a low temperature grading of 0W or better. Oils with cross gradings of 0W20, 0W30, 0W40 or even more widely cross graded, for example 0W70 or higher may be achieved. Engine oils, cross graded such as 0W70 and 25W70, may achieve excellent wear performance even under conditions of high levels of fuel dilution, indicating that the use of the low molecular weight highly viscoelastic component in combination with the high molecular weight polymer component is capable of countering the deleterious oil film thinning effects of fuel dilution on low viscosity base oils. Another particular achievement of this invention is in formulating very low viscosity highly fuel efficient oils with a 0W low temperature rating, which have a cross-grading of 0W-20 or wider, such as 0W-30, which are capable of passing the ASTM Sequence VE wear test, in which high levels of fuel, water, and blow-by contaminants accumulate in the oil during the 12-day, low-temperature test. Although it has previously been possible to pass the high-temperature Sequence III E wear test with a very low-viscosity 0W-20 or 0W-30 oil, passing the very demanding Sequence V E test had so far been highly elusive.

DRAWINGS

The single FIGURE of the drawings is a graphical representation of the improvement in film thickness achieved by the present synthetic lubricating oils.

DETAILED DESCRIPTION

General Considerations

The present high performance lubricants are highly cross graded engine oils which may be based on mineral derived base oils or synthetic basestocks but the advantages may also be secured in lubricants formulated as axle and transmission oils and industrial oils.

The invention will be described with primary reference to engine oils, which represent the prime utility of the invention but it is also applicable to these other classes, as noted. In terms of cross graded engine oils, the lubricants may be separated into two groups. The first group is the group which has a low temperature grade of 0W, implying a cold cranking viscosity (ASTM D 5293) of not more than 3250 cP maximum at −30° C. These 0W oils necessarily have a very low viscosity at low temperatures in order to meet the extreme low temperature fluidity requirement. Since the low viscosity basestocks required to meet this portion of the specification have a low viscosity at the 100° C. temperature used for establishing the high temperature viscosity grade, as well as at actual engine operating temperatures, the 0W cross-graded oil is very difficult of achievement. However, by combining the present components, it has been found possible to produce oils conforming to the 0W requirement which have excellent wear performance under the actual conditions of use, indicative of good film thickness under shear thinning conditions encountered at high temperatures. Thus, the excellent low temperature oils of the present invention are 0W grade oils such as 0W20, 0W30, 0W40 and even more highly cross-graded oils, including 0W70, 0W80, 0W90 and 0W100 multi-grade oils. As noted above, the ability to attain Sequence V E wear test performance with a 0W-30 rated oil is an excellent indicator of the improved wear performance of the present oils.

The advantages of the present invention may also be secured in other oils with a significant low temperature performance requirement, for example, 5W oils with a high temperature grade of at least 50. For example, cross-graded oils are 5W60, 5W70 and higher may be readily achieved in the same way as with the 0W oils.

Although indicated by a low temperature performance rating, e.g. 0W or W, the present oils are highly satisfactory under high temperature operating conditions and in commercial use, the viscosities characteristic of these low temperature ratings translate into improved fuel economy in actual operation. Thus, in addition to providing ready starting and improved lubrication from start-up, the present oils result in better fuel mileage and overall economy.

One factor which is believed to be significant is that the present oils exhibit improved air release characteristics (ASTM D3427), both in terms of the maximum amount of air entrained and in terms of air released within a given time (time in minutes to attain 0.2% and 0.1% air retained in the bulk oil, in the ASTM method). The air retention is believed to be associated with the improved viscoelasticity and film thickness achieved with the present lubricants since the elimination of air rapidly from the body of the liquid enables the lubricant fluid properties to dominate. The maximum amount of air entrained at 1.0 minutes (ASTM D3427) of the. present oils is less than 3% air, preferably less than 2.5% air, and in the most favorable cases, less than 2.0%.

Base Oils

Because the present oils need to meet the low temperature viscosity requirement, the basestocks used in them will be relatively low viscosity basestocks, generally below 10 cSt at 100° C. (all viscosity measurements in the specification are at 100° C. unless specified otherwise). Generally, the viscosity of the blended basestocks may be in the range of 2 to 12 cSt. This may be achieved by blending higher viscosity basestocks with basestocks of viscosities below 2 cSt, e.g. about 1.5 cSt, although stocks which are less viscous than this tend to be too volatile, making it difficult to comply with volatility specifications, e.g. NOACK. For example, blends of 2 cSt and 4 cSt and or 2 cSt and 6 cSt (nominal) components may be used. Basestocks of 4 to 6 cSt will be found particularly useful for the present types. The viscosity index (VI) of the useful hydrocarbon base stocks are normally 80 or greater, preferably 95 or greater, and most preferably 110 or greater. Further, a minimum 10% of base stock with VI of 110 or greater is highly desirable in order to balance the use of low-VI base stock components. In some applications, 50% to 90% can be effectively used, and may be preferred. The low viscosity basestock may be a mineral-derived oil basestock, typically a light neutral, or a synthetic basestock. Synthetic hydrocarbon basestocks are preferred, especially the PAOs with viscosities in the range of 1.5 to 12 cSt, generally with VI's of 120 or greater, either in the form of single component or blended PAOs. For example, PAO at 4 cSt has a viscosity index of 120. As alternatives, other synthetic basestocks may be used, for example, alkylbenzenes, and other alkylated aromatics such as alkylated diphenyl oxides, alkylated diphenyl sulfides and alkylated diphenyl methanes, although these are presently not preferred. In all cases, a viscosity range of about 1.5 to 12 cSt will normally be found satisfactory. Other synthetic basestocks may also be utilized, for example those described in the seminal work "Synthetic Lubricants", Gunderson and Hart, Reinhold Publ. corp., New York 1962. In alkylated aromatic stocks, the alkyl substituents are typically alkyl groups of about 8 to 25 carbon atoms, usually from 10 to 18 carbon atoms and up to three such substituents may be present, as described for the alkyl benzenes in ACS Petroleum Chemistry Preprint 1053–1058, "Poly n-Alkylbenzene Compounds: A Class of Thermally Stable and Wide Liquid Range Fluids", Eapen et al, Phila. 1984. Tri-alkyl benzenes may be produced by the cyclodimerization of 1-alkynes of 8 to 12 carbon atoms as described in U.S. Pat. No. 5,055,626.

Other alkylbenzenes are described in EP 168 534 and U.S. Pat. No. 4,658,072. Alkylbenzenes have been used as lubricant basestocks, especially for low temperature applications (Arctic vehicle service and refrigeration oils) and in papermaking oils; they are commercially available from producers of linear alkylbenzenes (LABs) such as Vista Chem. Co., Huntsman Chemical Co., as well as Chevron Chemical Co., and Nippon Oil Co. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993.

The hydrocracked and hydroisomerized oils represent classes of oils of mineral or synthetic origin which may be used to advantage in the present lubricants. Oils of these types, classified as API Group III basestocks (at least 90 percent saturates, no more than 0.03 percent sulfur, VI at least 120) are currently being produced by the hydrocracking and hydroisomerizing of various hydrocarbon streams of mineral or synthetic origin, including distillates such as vacuum gas oil as well as waxes. The hydrocracked and hydroisomerized waxes are especially favorable since they have high values of viscosity index resulting from their origin as highly paraffinic waxy materials; added to this they are also characterized by low pour points resulting from the isomerization reactions which take place during the hydroprocessing and which convert the waxy n-paraffins in them to less waxy iso-paraffins of high viscosity index. The resulting hydroprocessed oils therefore possess a desirable combination of properties as lubricant basestocks. A particularly desirable class of hydroisomerized Group III bases stocks are the hydroisomerized Fischer-Tropsch waxes. These waxes, the high boiling point residues of Fischer-Tropsch synthesis, are highly paraffinic hydrocarbons with a very low sulfur content consistent with their synthetic origin. The hydroprocessing used for the production of such basestocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in GB 1 429 494; 1 350 257; 1 440 230 and 1 390 359. Particularly favorable processes are described in EP 464 546 and 464 547. Processes using Fischer-Tropsch wax feeds are described in U.S. Pat. Nos. 4,594,172 and 4,943,672.

Poly Alpha Olefins

Poly Alpha Olefins (PAOs) are the preferred low viscosity basestock components of the present compositions. The average molecular weights of the PAOs, which are known materials and generally available on a major commercial scale from suppliers such as Mobil Chemical Company, typically vary from about 250 to about 10,000, although PAO's may be made in viscosities up to about 1,000 cSt (100° C.). The PAOs are and typically comprise relatively low molecular weight hydrogenated polymers or oligomers of alphaolefins which include but are not limited to $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-decene and poly-1-dodecene although the dimers of higher olefins in the range of $C_{14}$ to $C_{18}$ may be used to provide low viscosity basestocks of acceptably low volatility. The PAOs in the required viscosity range of 1.5 to 12 cSt, are generally predominantly trimers and tetramers of the starting olefins, with minor amounts of the higher oligomers, depending on the exact viscosity grade and the starting oligomer.

The PAO fluids may be conveniently made by the polymerization of analphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Patents:. 3,742,082 (Brennan); 3,769,363 (Brennan); 3,876,720 (Heilman); 4,239,930 (Allphin); 4,367,352 (Watts); 4,413,156 (Watts); 4,434,408 (Larkin); 4,910,355 (Shubkin); 4,956,122 (Watts); 5,068,487 (Theriot). The dimers of the $C_{14}$ to $C_{18}$ olefins are described in U.S. Pat. No. 4,218,330.

Esters and Other Base Oil Components

In addition to the two polymeric components and the low viscosity basestock component, the low viscosity basestock may also comprise other liquid components of comparable viscosity, in the range of 1.5 to 12 cSt, either mineral or synthetic in origin in order to achieve the desired combination of properties in the finished lubricant. For example, when the PAOs, which are highly paraffinic in character, are used as the principal basestock components, it may be desirable to utilize another component which possesses additional chemical functionality (e.g. aromatic, ester, ether, alcohol, etc.) in order to confer the desired additive solvency and seal swell characteristics. Certain additives used in oils contain aromatic groups, and for adequate solvency, some aromatic character in the basestock may be required, even though aromatics, generally, do not lead to optimum lubricant performance in themselves. Additive solvency and seal swell characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols e.g. neopentyl glycol, trimethylol ethane, 2-methyl-2-propyl-1,3-propanediol, trimethylol propane, pentaerythritol and dipentaerythritol with alkanoic acids containing at least 4 carbon atoms such as the, normally the $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid.

The most suitable synthetic ester components are the esters of trimethylol propane, trimethylol butane, trimethylol ethane, pentaerythritol and/or dipentaerythritol with one or more monocarboxylic acids containing from about 5 to about 10 carbon atoms are widely available commercially, for example, the Mobil P-41 and P-51 esters (Mobil Chemical Company).

While the esters provide satisfactory additive solvency and seal swell characteristics, they are subject to hydrolysis in the presence of small amounts of moisture which accumulate in crank case oils as a product of combustion. Superior performance may be obtained by the use of certain alkylated aromatic compounds in combination with the PAOs for example, alkylbenzenes, alkylmethylenes, alkyldiphenyloxides and diphenylsulfides, of which the alkylated naphthalenes are preferred. Combinations of alkylated naphthalenes and PAOs are described in U.S. Pat. No. 5,602,086, to which reference is made for a description of alkylated naphthalenes (AN), methods for making them and of AN/PAO combinations.

The basestock component of the present oils will typically be from 50 to 95 weight percent of the total composition (all proportions and percentages set out in this specification are by weight unless the contrary is stated) and more usually in the range of 50 to 85 weight percent. With the low viscosity synthetic oils, the amount of the basestock component is typically from 65 to 90 percent and will tend to be at the higher end of this range for the oils with a low temperature viscosity requirement, e.g. 0W, especially when a high viscosity HVI-PAO is used as the amount of the high viscosity material required in the formulation is less. When PAOs are used as the low viscosity component of the basestock in combination with an ester, the relative amounts of PAO and ester will typically be in the range of about 20:1 to 1:1, normally 10:1 to 2:1. If a low viscosity alkyl aromatic is used in combination with the low viscosity hydrocarbon basestock component, the PAO:alkylaromatic ratio will typically be from 20:1 to 2:1, normally 15:1 to 10:1.

Viscoelastic Polymer

The third characteristic component of the present oils which is normally present in a relatively small amount is the low molecular weight polymer with good viscoelastic characteristics. This polymer is marked by a viscoelastic characteristic. Elasticity is a characteristic of polymer-containing fluids, but the level is a function of molecular weight, type and concentration. The potential for bearing journal lubrication benefits from oil elasticity contributed by polymeric VI improvers is well established. See, for example, J. Inst. Petrol. Tech. 40, 191 (1954), ASLE Trans. 4, 97 (1961), ASLE Trans. 8, 179 (1965), Davies et al "The Rheology of Lubricants", John Wiley, NY 1973, page 65 and Trans. Soc. Rheol. 20, 65 (1976). It has been theorized that the explanation for these benefits is that in the case of full hydrodynamic lubrication, oil elasticity can generate an additional force on the journal in a direction tending to increase the minimum film thickness. This elastic force is at a right angle to the force due to viscosity and is associated with the first normal stress difference, N. induced when viscoelastic fluids are sheared—the higher the value of $N_1$, the higher the elasticity. For the oils of the present invention, it is preferred that the value of $N_1$ for the fully formulated oil should be at least 11 and preferably at least 15 kPa, reported at a shear at shear stress ($\tau$)=10 kPa (as measured by a slit die rheometer, for example a Lodge Stressmeter (Bannatek Co., see SAE Paper No. 872043). In favorable cases, the value of $N_1$ may be at least 18 kPa or even higher, for example, at least 25 kPa. By contrast, conventionally formulated oils typically have values below about 10 kPa under the same conditions.

The preferred class of materials meeting this requirement is the HVI-PAOoligomers, the type described in U.S. Pat. Nos. 4,827,064 and 4,827,073, referred to above. Various modifications and variations of these HVI-PAO materials are also described in the following U.S. Patents to which reference is made: 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. No. 5,012,020 and U.S. Pat. No. 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19.

Although characterized as a relatively lower molecular weight and lower viscosity component of the oil (relative to the high molecular weight polymer), this liquid viscoelastic polymer material will generally have a viscosity which is intermediate that of the low viscosity basestock components (e.g. low viscosity PAO, ester and/or alkyl aromatic) and that of the high molecular weight polymer. It will normally have a viscosity in the range of about 12 to 3,000 cSt, e.g. 20 to 1,000 or more usually, 40 to 1,000 cSt; in many cases, a viscosity from about 100 to 1,000 cSt can be usefully employed. This component will typically comprise about 0.1 to about 25 weight percent, normally 0.1 to 20, e.g. 0.1 to 15, weight percent, of the total finished lubricant. In most cases, at least 1 percent will be present although with the higher molecular weight polymers, less it has been found that the relatively higher molecular weight HVI-PAO oligomers have the most favorable (and unexpected) effect on the air entrainment and air release characteristics (ASTM D-3427) of the oils. For this reason, HVI-PAOs with a viscosity of at least 1,000 cSt, for example, from 1,000 to 3,000 cSt will be preferred for optimal air entrainment and air release properties.

Polymeric Thickener

In addition to the low viscosity basestock components and the relatively low molecular weight polymeric viscoelastic component, the lubricants also include a relatively high molecular weight component which has a marked viscosity thickening property when blended with the lower molecular weight components of the basestock. As noted above, these polymeric components typically have a molecular weight from about 10,000 to 1,000,000 normally in the range of 100,000 to 1,000,000. They are normally hydrogenated styrene-isoprene block copolymers, rubbers based on ethylene and propylene, high molecular weight acrylate or methacrylate esters, and polyisobutylenes and other materials of high molecular weight which are soluble in the basestocks and which, when added to the basestocks, confer the required viscosity to achieve the desired high temperature viscosity grade e.g. 20, 30, 40, 50, 60, 70, 80, 90, 100. These materials are readily available commercially from a number of suppliers according to type.

The preferred polymeric materials of this class for use in the present formulations are the block copolymers produced by the anionic polymerization of unsaturated monomers including styrene, butadiene, and isoprene. Copolymers of this type are described in U.S. Pat. Nos. 5,187,236; 5,268,427; 5,276,100; 5,292,820; 5,352,743; 5,359,009; 5,376,722 and 5,399,629. Block copolymers may be linear or star type copolymers and for the present purposes, the linear block polymers are preferred. The preferred polymers are the isoprene-butadiene and isoprene-styrene anionic diblock and triblock copolymers. Particularly preferred high molecular weight polymeric components are the ones sold under the designation Shellvis™ 40, Shellvis™ 50 and Shellvis™ 90 by Shell Chemical Company, which are linear anionic copolymers; of these Shellvis™ 50 which is an anionic diblock copolymer is preferred. A less preferred class of anionic block copolymers are the star copolymers such as Shellvis™ 200, Shellvis™ 260 and Shellvis™ 300. These high molecular weight solid materials, may conveniently be blended into lubricants in the form of a solution of the solid polymer in other basestock components. The amount of the high molecular weight thickener is typically from 0.1 to 5 percent of the total lubricant, more usually from 0.5 to 3 percent of the total oil, depending upon the viscosity of the basestock components and the desired viscometrics, particularly the high temperature grade required. With relatively low viscosity basestock components, and a relatively high viscosity high-temperature grade requirement, more of the high molecular weight component will be required than if higher viscosity basestock components are used and there is a lower value for the high-temperature grade requirement. Thus, a widely cross-graded oils such as the 0W70, 0W90 and 0W100 will normally require more of the high molecular weight polymer thickener than the less widely cross-graded oils whereas the 0W oils with a relatively low high-temperature requirement such as the 0W20 oils will need relatively little of this thickening material.

An excellent discussion of types of high molecular weight polymers which may be used as thickeners or VI improvers is given by Klamann in Lubricants and Related Products, Verlag Chemie, Deerfield Beach, Fla.; ISBN 0-89573-177-0, which also gives a good discussion of other lubricant additives, as mentioned below. Reference is also made "Lubricant Additives" by M. W. Ranney, published by Noyes Data Corporation of Parkridge, N.J. (1973).

Additive Package

In addition to the low viscosity basestock components, the viscoelastic polymer and the high molecular weight polymeric thickener, the present oils will also include an additive package to impart or enhance the desired performance properties of the finished oil. These additives and the overall package will generally be conventional in type for a lubricant of mineral or synthetic origin, depending upon the type of basestock used. The types of additive which may normally be required include, for example, the following: (1) oxidation inhibitors, (2) dispersants, (3) detergents, (4) corrosion inhibitors, (5) metal deactivators, (6) anti-wear agents, (7) extreme pressure additives, (8) pour point depressants, (9) viscosity index improvers (VII), (10) seal compatibility agents, (11) friction modifiers and (12) defoamants.

Oxidative stability is provided by the use of antioxidants and for this purpose a wide range of commercially available materials is available, as noted by Klamann op cit. The most common types of are the phenolic antioxidants and the amine type antioxidants, of which the latter are preferred. They may be used individually by type or in combination with one another.

The phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl4-heptyl phenol; 2-t-butyl-4-octyl phenol; 2-t-butyl4-dodecyl phenol; 2,6-di-t-butyl4-heptyl phenol; 2,6-di-t-butyl4-dodecyl phenol; 2-methyl-6-di-t-butyl4-heptyl phenol; and 2-methyl-6-di-t-butyl-4-dodecyl phenol. Examples of ortho coupled phenols include: 2,2'-bis(6-t-butyl-4-heptyl phenol); 2,2'-bis(6-t-butyl4-octyl phenol); and 2,2'-bis(6-t-butyl4-dodecyl phenol).

Non-phenolic oxidation inhibitors which may be used include the aromatic amine antioxidants and these may be used either as such or in combination with thephenolics. Typical examples of non-phenolic antioxidants include: alkylated and non-alkylated aromatic amines such as the aromatic monoamines of the formula $R^3R^4R^5N$ where $R^3$ is an aliphatic, aromatic or substituted aromatic group, $R^4$ is an aromatic or a substituted aromatic group, and $R^5$ is H, alkyl, aryl or $R^6S(O)_xR^7$ where $R^6$ is analkylene, alkenylene, or aralkylene group, $R^7$ is a higher alkyl group, or an alkenyl, aryl, oralkaryl group, and x is 0, 1 or 2. The aliphatic group $R^3$ may contain from 1 to about 20 carbon atoms, and preferably contains from 6 to 12 carbon atoms. The aliphatic group is a saturated aliphatic group. Preferably, both $R^3$ and $R^4$ are aromatic or substituted aromatic groups, and the aromatic group may be a fused ring aromatic group such as naphthyl. Aromatic groups $R^3$ and $R^4$ may be joined together with other groups such as S. Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenyl amines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyidiphenylamine; octylphenyl-beta-naphthylamine; t-octylphenyl-alpha-naphthylamine; phenyl-alphanaphthylamine; phenyl-beta-naphthylamine; p-octylphenyl-alpha-naphthylamine; 4-octylphenyl-l-octyl-beta-naphthylamine.

Normally, the total amount of antioxidant will not exceed 10 wt. percent of the total composition and normally is below about 5 wt. percent, typically from 1 to 2 wt. percent.

Dispersants are also a known group of functional additives for lubricating oils, being used to maintain oxidation products in suspension in the oil, preventing accumulations of debris which could score bearings, block oilways and cause other types of damage as well as preventing deposit formation and inhibiting corrosive wear by the neutralization of acidic combustion products. Dispersants may be ash-containing or ashless in character, of which the ashless variety are preferred. Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in EP 471071, to which reference is made for this purpose.

The detergents are also an important additive component, serving to maintain overall cleanliness. Chemically, many detergents are similar to the dispersants as noted by Klamann and Ranney op cit. Ranney discloses a number of overbased metal salts of various sulfonic acids which are useful as detergents/dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates which are useful as dispersants/detergents.

Corrosion inhibitors or metal suppressors are not normally required in the present compositions but may be optionally be added, depending on the type of metals to be encountered in operation. A wide variety of these are commercially available; they are referred to also in Klamann, op. cit.

The antiwear agents typified by the zinc dialkyl dithiophosphates such as the zinc di(iso-hexyl) dithiophosphate are preferably added to the present compositions since, although the combination of low and high molecular weight polymers in the low viscosity basestocks acts to increase film thickness in elastohydrodynamic conditions, the additional effect of the additive is desirable under severe operational conditions.

Pour point depressants and viscosity index improvers (VII) will not normally be required in the present oils because the low viscosity basestocks usually possess a sufficiently low pour point that no further modification of this property is required. However, conventional pour point improvers may be added as desired. The high molecular weight polymer component acting as a viscosity modifier and also as a VI improver will normally, in combination with the highly viscoelastic HVI-PAO component, confer a sufficiently high value of VI on the oil that no further augmentation is required but again, conventional additives of this type may optionally be used. Both these types of additive are described in Klamann, op cit.

Seal compatibility agents will normally be required as the highly paraffinic nature of the preferred basestocks makes it necessary to use this additive to meet seal compatibility specifications. Additives of this type are commercially available, for example, as various aromatic esters, and may be used in conventional amounts, typically from 0.1 to 5 percent of the total lubricant, usually from 0.5 to 2 percent, depending on the actual composition.

The friction modifiers (friction reducing agents) are a desirable class of additives and again, are commercially available as various fatty acid and/or ester derivatives. They also are described in Klamann, op cit. Glycerol esters such as the glycerol mono-oleates are a preferred class of friction modifiers for the present lubricants; they are suitably used in an amount from 0.1 to 1 percent of the total lubricant.

Defoamants, typically silicone compounds, are commercially available and may be used in conventional minor amounts along with other additives such as demulsifiers; usually the amount of these additives combined is less than 1 percent and often less than 0.1 percent.

Example 1

A number of oils were formulated to varying viscosity grades (SAE, and extended) to illustrate the cross-graded lubricants with excellent low temperature performance according to the present invention. Compositions are weight percentages.

TABLE 4a

0W MULTIGRADE ENGINE OILS

| Example No. | 1-1 | 1-2 | 1-3 | 1-4 |
|---|---|---|---|---|
| Viscosity Grade | 0W-20 | 0W-30 | 0W-50 | 0W60 |
| Polymeric Thickener 1 | 0.36 | 0.84 | | |
| Polymeric Thickener 2 | | | 2.40 | 2.20 |
| Polymeric Thickener 3 | | | | |
| HVI-PAO, 150 cSt | 2.0 | 2.0 | 10.00 | 10.00 |
| PAO, 5.6 cSt | 10.0 | | | |
| PAO, 4 cSt | 63.37 | 73.58 | 25.37 | 50.57 |
| PAO, 1.7 cSt | | | 25.00 | |
| Ester | — | | 25.00 | 25.00 |
| Alkyl Aromatic | 8.46 | 7.05 | | |
| Performance Additives Package | 15.81 | 16.53 | 12.23 | 12.23 |
| KV @ 100 C. (cS) | 9.10 | 9.80 | 20.67 | 23.10 |
| CCS @ −30 C. (cP) | 2600 | 3000 | 1500 | 2700 |
| HTHS @ 150 C. (cP) | 2.90 | 3.00 | 4.73 | 5.42 |

Notes:
Polymeric Thickener 1 Shellvis ™ 50
Polymeric Thickener 2 Shellvis ™ 260
Polymeric Thickener 3 Shellvis ™ 300

TABLE 4b

0W MULTIGRADE ENGINE OILS

| Example No. | 1-5 | 1-6 | 1-7 | 1-8 | 1-9 |
|---|---|---|---|---|---|
| Viscosity Grade | 0W70 | 0W-70 | 0W-80 | 0W-90 | 0W-100 |
| Polymeric Thickener 1 | 2.74 | | | | |
| Polymeric Thickener 2 | | | 3.30 | 3.36 | |
| Polymeric Thickener 3 | | 2.08 | | | 3.12 |
| HVI-PAO, 150 cSt | 2.00 | 10.00 | 10.00 | 10.00 | 10.00 |
| PAO, 8 cSt | 1.00 | | | | |
| PAO, 5.6 cSt | 1.00 | | | | |
| PAO, 4 cSt | 53.89 | 50.69 | 24.47 | 24.41 | 24.65 |
| PAO, 1.7 cSt | | | 25.00 | 25.00 | 25.00 |
| Ester | 25.00 | 25.00 | 25.00 | 25.00 | 25.00 |
| Performance Additives Package | 14.37 | 12.23 | 12.23 | 12.23 | 12.23 |
| KV @ 100 C. (cS) | 26.93 | 27.57 | 34.04 | 36.60 | 44.57 |
| CCS @ −30 C. (cP) | 3100 | 2900 | 2000 | 2000 | 1950 |
| HTHS @ 150 C. (cP) | 5.51 | 5.40 | 6.37 | 6.36 | 6.32 |

Notes:
Polymeric Thickener 1 Shellvis ™ 50
Polymeric Thickener 2 Shellvis ™ 260
Polymeric Thickener 3 Shellvis ™ 300

Example 2

A synthetic PAO-based 5W-60 oil was prepared as shown in Table 5 below.

TABLE 5

| 5W-60 Engine Oil | |
|---|---|
| Polymeric Thickener 1 | 2.40 |
| HVI-PAO, 150 cSt | 8.00 |
| PAO, 4 cSt | 49.74 |
| Ester | 22.80 |
| Performance Additives | 17.06 |
| KV @ 100 C. (cS) | 24.0 |
| CCS @ −25 C. (cP) | 2980 |
| HTHS @ 150 C. (cP) | 5.60 |

Example 3

This example demonstrates the potential for achieving a pass on the ASTM Sequence V-E test, using a combination of the three synthetic components in the lubricant. The oil was formulated as a 0W-30 oil but the concept would also be applicable for 0W-20 cross grade with appropriate formulation changes. The test results are shown in Table 6 below.

TABLE 6

Wear Protection Performance of in Sequence VE Engine Test

| Example No. | | 3-1 | 3-2 |
|---|---|---|---|
| Viscosity Grade: | | 0W-30 | 0W-30 |
| Formulation (Wt. %) | | | |
| Shellvis ™ 50 | | 0.90 | 0.78 |
| HVI-PAO 150 cSt | | — | 2.00 |
| Synthetic Base Oils (PAO/Aromatic; 9/1) | | 84.27 | 82.39 |
| Performance Additive Package | | 14.83 | 14.83 |
| Physical Properties | | | |
| KV @ 100 C. (cSt) | D445-5 | 9.8 | 9.8 |
| KV @ 40 C. (cSt) | D445-3 | 51.0 | 51.4 |
| Viscosity Index | D-2270 | 181 | 179 |
| CCS @ −30 C. (cP) | D5293-6 | 1980 | 2110 |
| HTHS @ 150 C. (cP) | D4683 | 2.88 | 2.89 |
| Sequence VE Test | Limits | | |
| Avg. Engine Sludge | 9.0 Min | 7.1 | 9.5 |
| Rocker Cover Sludge | 7.0 Min | 5.5 | 9.1 |
| Piston Skirt Varnish | 6.5 Min | 7.5 | 7.2 |
| Avg. Engine Varnish | 5.0 Min | 6.0 | 5.8 |
| Cam Lobe Wear, $\mu$m | | | |
| Maximum | 380 Max | 415 | 28 |
| Average | 127 Max | 189 | 18 |
| Oil Screen Clogging, % | 20 Max | 0 | 0 |
| Assessment: | | Fail | Pass |

These results show that the use of the three components of the present oils combine to provide the required characteristics for the Sequence V-E wear test pass.

Example 4

This example illustrates the effect of the HVI-PAO oligomer viscosity on the air entrainment and air release characteristics of the lubricant. Oils were formulated to a 5W-30 grade and tested for air release characteristics by ASTM D-3427. The results are shown in Table 7 below.

TABLE 7

Formulation Effects on D3427 Air Release

| Example No | 4-1 | 4-2 | 4-3 | 4-4 | 4-5 |
|---|---|---|---|---|---|
| Viscosity Grade | 10W-30 | 5W-30 | 5W-30 | 5W-30 | 5W-30 |
| PAO 100 cSt | 20.25 | | | | |
| HVI-PAO 150 cSt | | 20.00 | | | |
| HVI-PAO 300 cSt | | | 15.55 | | |
| HVI-PAO 1000 cSt | | | | 9.82 | |
| HVI-PAO 3000 cSt | | | | | 6.82 |
| PAO 4 cSt | 47.32 | 47.57 | 52.02 | 57.75 | 60.75 |
| PAO 6 cSt | 1.00 | 1.00 | 1.00 | 1.00 | 1.00 |
| Ester | 17.00 | 17.00 | 17.00 | 17.00 | 17.00 |
| Additive Package | 14.43 | 14.43 | 14.43 | 14.43 | 14.43 |
| KV @ 100 C. (cSt) | 11.78 | 11.50 | 11.7 | 11.58 | 11.7 |
| CCS @ −25 C. (cP) | 4630 | 3090 | 3150 | 2440 | 2100 |
| HTHS @ 150 C. (cP) | 3.92 | 3.91 | 4.01 | 3.93 | 3.84 |
| ASTM D3427 | | | | | |
| Max. % Air @ 1 min. | 2.51 | 1.92 | 1.50 | 1.60 | 0.25 |
| Time (min) to 0.1% Air | 14.63 | 11.38 | 10.10 | 10.10 | 1.78 |
| Time (min) to 0.2% Air | 12.59 | 10.27 | 8.50 | 8.11 | 1.25 |

Example 5

This example illustrates the effect of the linear high molecular weight polymer on the air entrainment and air release characteristics as compared to the star type polymer. The results of testing oils formulated to 5W-50 with a combination of high molecular weight thickener, PAO base oil and HVI-PAO component, are shown in Table 8 below.

TABLE 8

5W-50 Cross Grade Oils; D3427 Air Release

| Example No. | 5-1 | 5-2 | 5-3 | 5-4 |
|---|---|---|---|---|
| Shellvis ™ 50 | 1.75 | 1.75 | | |
| Shellvis ™ 260 | | | 1.48 | 1.48 |
| HVI-PAO 150 cSt | 20.00 | | 20.00 | |
| HVI-PAO 3000 cSt | | 6.00 | | 6.50 |
| PAO6 | 0.80 | 0.80 | 0.80 | 0.80 |
| PAO4 | 52.23 | 66.23 | 52.50 | 66.00 |
| Ester | 13.68 | 13.68 | 13.68 | 13.68 |
| Performance Additive Package | 11.54 | 11.54 | 11.54 | 11.54 |
| KV @ 100 C. (cS) | 19.75 | 20.49 | 20.39 | 20.79 |
| CCS @ −25 C. (cP) | 3500 | 2200 | 3350 | 2200 |
| HTHS @ 150 C. (cP) | 5.58 | 5.37 | 5.82 | 5.57 |
| ASTM D3427 | | | | |
| Max. % Air @ 1 min. | 2.56 | 2.67 | 3.39 | 3.79 |
| Time (min) to 0.1% Air | 18.65 | 12.95 | 20.94 | 14.32 |
| Time (min) to 0.2% Air | 15.62 | 10.84 | 16.98 | 13.06 |

The results in Table 8 above show that the air entrainment and air release characteristics are better with the linear polymer thickener (e.g. compare 5-1 versus 5-3), and that the higher viscosity HVI-PAO component promotes faster air release with a given polymer thickener (e.g. compare 5-1 versus 5-2).

Example 6

This example demonstrates the improvement in film thickness which may be achieved by the use of the present combination of components. Two oils were formulated to SAE grade 0W-20 as shown in Table 9 below, one oil. containing a HVI-PAO (150 cSt) component and one without. The film thicknesses of the oils under EHL conditions were then measured in a point contact (ball-on-disk) test rig using an optical detector (Reference: "The Measurement and Study of Very Thin Lubricant Films in Concentrated Contacts," by G. J. Johnston, R. Wayte, and H. A. Spikes, Tribology Transactions, Vol. 34 (1991), 2, 187–194.). The results are shown graphically in FIG. 1.

TABLE 9

SAE 0W-20 Engine Oils

| Example No. | | 6-1 | 6-2 |
|---|---|---|---|
| Formulation (Wt. %) | | | |
| Shellvis ™ 50 | | 0.37 | 0.36 |
| HVI-PAO 150 cSt | | — | 2.00 |
| Synthetic Base Oils (PAO/Aromatic; 9/1) | | 83.82 | 81.83 |
| Additive Package | | 15.81 | 15.81 |
| Physical Characteristics | | | |
| KV @ 100 C. (cSt) | 445-5 | 8.3 | 8.6 |
| KV @ 40 C. (cSt) | 445-3 | 43.4 | 45.9 |
| Viscosity Index | | 169 | 169 |
| CCS @ −30 C. (cP) | 5293-6 | 2310 | 2590 |
| HTHS @ 150 C. (cP) | 4683 | 2.71 | 2.64 |

The figure shows the effectiveness of including the HVI-PAO component in the present oils. The FIG. 1 plots the film thickness (nm) against speed in the test rig for the 0W-20 oil containing the HVI-PAO component and the other 0W-20 oil. The plot shows that at lower speeds in the regime of elastohydrodynamic lubrication, the high elasticity polymer boosts the effective film thickness, thus reducing wear effectively in this regime. At higher speeds, however, in the hydrodynamic lubrication regime, the conventional film properties are sufficient to ensure adequate film thickness.

Example 7

A comparison of viscoelasticity is provided by the following comparative formulations to varying viscosity grades.

TABLE 10

ViscoElasticity Performance of Oils

| Example No. | 7-1 | 7-2 | 7-3 | 7-4 | 7-5 |
|---|---|---|---|---|---|
| Viscosity Grade | −5W-40 | 0W-30 | 5W-30 | 0W-20 | 0W-30 |
| Formulation (Wt. %) | | | | | |
| Shellvis ™ 50 | 1.9 | | | | |
| Acryloid ™ 956 | | 8.5 | 4.5 | | |

TABLE 10-continued

| ViscoElasticity Performance of Oils | | | | | | |
|---|---|---|---|---|---|---|
| Example No. | | 7-1 | 7-2 | 7-3 | 7-4 | 7-5 |
| HVI-PAO 1000 cSt | | | | | 8.00 | |
| HVI-PAO 3000 cSt | | | | | | 6.00 |
| Synthetic Base Oils (PAO/Ester; 3/1) | | 84.45 | 77.85 | 81.85 | 78.35 | 80.35 |
| Additive Package | | 13.65 | 13.65 | 13.65 | 13.65 | 13.65 |
| Physical Characteristics | | | | | | |
| KV @ 100 C. (cSt) | D445-5 | 14.4 | 11.9 | 10.9 | 9.2 | 10.0 |
| KV @ 40 C. (cSt) | D445-3 | 71.8 | 55.4 | 60.4 | 45.6 | 48.2 |
| Viscosity Index | | 210 | 216 | 173 | 188 | 199 |
| CCS @ −25 C. (cP) | D5293-5 | | | 3000 | | |
| CCS @ −30 C. (cP) | D5293-6 | 1880 | 2410 | | 2600 | 2520 |
| CCS @ −35 C. (cP) | | 3210 | | | | |
| HTHS @ 150 C. (cP) | D4683 | 3.3 | 3.2 | 3.3 | 3.2 | 3.3 |
| Viscoelasticity | | | | | | |
| First Normal Stress Difference, $N_1$ (kPa), @ Shear Stress = 10 kPa | | 4 | 8 | 11 | 18 | 28 |

In Table 10 above, comparison of Formulations 7-2 and 7-5, both 0W-30 grade, shows that the HVI-PAO component is associated with a high value of viscoelasticity which, in turn, can be correlated with improved film thickness in the fully formulated lubricant. Formulation 74 is also demonstrative of the high, values of viscoelasticity associated with the HVI-PAO component.

Example 8

This Example illustrates the potential for obtaining improved air entrainment and air release characteristics in a widely cross-graded oil containing the HVI-PAO component. Two oils were formulated to viscosity grade 0W-70 using a linear and a star polymer type thickener.

TABLE 11

| Wide Cross Grade Oils, 0W-70; D3427 Air Release | | |
|---|---|---|
| Example No. | 8-1 | 8-2 |
| Viscosity Grade | 0W-70 | 0W-70 |
| Shellvis ™ 50 | 2.74 | |
| Shellvis ™ 260 | | 2.27 |
| HVI-PAO 150 cSt | 2.00 | 2.00 |
| PAO8 | 1.00 | 1.00 |
| PAO6 | 1.00 | 1.00 |
| PAO4 | 53.89 | 54.36 |
| Ester | 25.00 | 25.00 |
| Performance Additives Package | 14.37 | 14.37 |
| KV @ 100 C. (cS) | 26.93 | 26.85 |
| CCS @ −30 C. (cP) | 3110 | 3080 |
| HTHS @ 150 C. (cP) | 5.51 | 6.05 |
| ASTM D3427, 75 C. | | |
| Max. % Air @ 1 min. | 1.42 | 1.96 |
| Time (min) to 0.1% Air | 7.55 | 9.79 |
| Time (min) to 0.2% Air | 6.76 | 8.60 |

Example 9

This Example illustrates the potential for obtaining improved air entrainment and air release characteristics in a widely 10W-60 cross-graded oil containing the HVI-PAO component. These oils were formulated using a linear and a star polymer type thickener, alone or in combination.

TABLE 12

| Wide Cross Grade Oils, 10W-60; D3427 Air Release | | | | | |
|---|---|---|---|---|---|
| Example No. | 9-1 | 9-2 | 9-1 | 94 | 9-5 |
| Viscosity Grade | 10W-60 | 10W-60 | 10W-60 | 10W-60 | 10W-60 |
| Shellvis ™ 50 | 2.19 | | | 1.10 | 1.10 |
| Shellvis ™ 260 | | 1.52 | | 0.76 | |
| Shellvis ™ 300 | | | 1.30 | | 0.65 |
| HVI-PAO 150 cSt | 20.00 | 20.00 | 20.00 | 20.00 | 20.00 |
| PAO6 | 1.00 | 1.00 | 1.00 | 1.00 | 1.00 |
| PAO4 | 45.23 | 46.05 | 46.27 | 45.71 | 45.81 |
| Ester | 17.16 | 17.00 | 17.00 | 17.00 | 17.01 |
| Performance Additive Package | 14.43 | 14.43 | 14.43 | 14.43 | 14.43 |
| KV @ 100 C. (cS) | 25.36 | 24.90 | 24.98 | 25.08 | 25.05 |
| CCS @ −20 C. (cP) | 2370 | 2490 | 2620 | 2730 | 2770 |
| HTHS @ 150 C. (cP) | 6.51 | 6.32 | 6.23 | 6.64 | 6.71 |
| ASTM D3427 | | | | | |
| Max. % Air @ 1 min. | 1.21 | 2.26 | 3.34 | 2.71 | 2.78 |
| Time (min) to 0.1% Air | 15.78 | 22.13 | 28.06 | 18.65 | 23.61 |
| Time (min) to 0.2% Air | 13.88 | 18.58 | 23.71 | 15.62 | 19.70 |

We claim:

1. A lubricant having improved antiwear properties, which comprises:

about 50 wt % to 90 wt % of a basestock comprising at least one member selected from the group consisting of a mineral-derived oil, a poly alpha olefin (PAO), and a hydroisomerized Fischer-Tropsch wax (F-T wax), wherein the basestock has a viscosity from 1.5 to 12 cSt (100° C.), about 0.1 wt % to about 20 wt % of a first polymer, and, about 0.1 wt % to 5 wt % of a second polymer of differing molecular weights blended into the liquid lubricant basestock component, the first polymer being of lower molecular weight than the second polymer and more highly viscoelastic than the second polymer, having a viscosity from 20 to 3000 cSt and produced by the polymerization of an alpha olefin in the presence of a reduced metal catalyst, the second polymer having a molecular weight of at least 100,000 and having viscosity thickening properties when blended with the liquid basestock.

2. A lubricant according to claim 1 in which the basestock comprises at least one member selected from the group consisting of a mineral-derived oil, a poly alpha olefin (PAO), and a hydroisomerized Fischer-Tropsch wax (F-T wax), and further comprising an ester or an alkylated aromatic compound.

3. A lubricant according to claim 1, wherein the second polymer comprises a block copolymer having a molecular weight from 100,000 to 1,000,000.

4. A lubricant according to claim 2 in which the basestock comprises a PAO and an ester.

5. A lubricant according to claim 2 in which the basestock comprises a PAO and an alkylated aromatic compound.

6. A synthetic engine oil having improved wear protection properties and improved viscoelastic film thickness which comprises:

about 50 wt % to 90 wt % of a liquid lubricant basestock having a viscosity from 1.5 to 12 cSt (100° C.) and comprising at least one poly alpha olefin (PAO) having a viscosity from 1.5 to 12 cSt (100° C.), about 0.1 wt % to about 20 wt % of a first polymer and about 0.1 wt % to 5 wt % of a second polymer of differing molecular weights blended into the liquid lubricant basestock, the first polymer (HVI-PAO) comprising a polymer having a viscosity from 20 to 3000 cSt and a lower molecular weight than the second polymer, produced by the polymerization of an alpha olefin in the presence of a reduced metal catalyst and possessing a higher viscoelasticity than the second polymer, the second, high molecular weight polymer having viscosity thickening properties when blended with the liquid basestock.

7. An engine oil according to claim 6 wherein the HVI-PAO has a viscosity from 'to 1,000 cSt (100C) and the second plymer comprises a block copolymer having a molecular weight from 100,000 to 1,000,000.

8. An engine oil according to claim 7 in which the basestock further comprises an ester.

9. An engine oil according to claim 7 in which the basestock further comprises an alkylated aromatic.

10. An engine oil according to claim 6 which has a low temperature viscosity grade of 0W and which comprises:

from 65 to 90 percent of a basestock component comprising at least one poly alpha olefin (PAO) having a viscosity from 1.5 to 6 cSt (100° C.), from 0.1 to 20 percent of the HVI-PAO, from 0.1 to 5 percent of the second polymer comprising a block copolymer having a molecular weight from 100,000 to 1,000,000.

11. An engine oil according to claim 10 which has a viscosity grade of OW-20 and which comprises:

from 65 to 90 percent of a basestock comprising at least one poly alpha olefin (PAO) having a viscosity from 1.5 to 6 cSt (100° C.), from 0.1 to 10 percent of the HVI-PAO, from 0.1 to 1 percent of the second polymer comprising a block copolymer having a molecular weight from 100,000 to 1,000,000.

12. An engine oil according to claim 10 having a high-temperature viscosity grade of 20 or higher, which passes the ASTM Sequence VE test.

13. An engine oil according to claim 11 which passes the ASTM Sequence VE test.

14. An engine oil according to claim 10 which has a viscosity grade of 0W-30 and which comprises:

from 65 to 90 percent of a basestock comprising at least one poly alpha olefin (PAO) having a viscosity from 1.5 to 6 cSt (100° C.), from 0.1 to 10 percent of the HVI-PAO, from 0.1 to 5 percent of the second polymer comprising a block copolymer having a molecular weight from 100,000 to 1,000,000.

15. An engine oil according to claim 14 which passes the ASTM Sequence VE test.

16. An engine oil according to claim 10 which has a low temperature viscosity grade of 0W and a high temperature viscosity grade of at least 50 and which comprises:

from 65 to 90 percent of a basestock comprising at least one poly alpha olefin (PAO) having a viscosity from 1.5 to 6 cSt (100° C.), from 0.1 to 20 percent of the HVI-PAO from 0.1 to 5 percent of the second polymer comprising a block copolymer having a molecular weight from 100,000 to 1,000,000.

17. An engine oil according to claim 10 which has a viscosity grade of 0W-70 and which comprises:

from 65 to 90 percent of a basestock comprising at least one poly alpha olefin (PAO) having a viscosity from 1.5 to 6 cSt (100° C.), from 0.1 to 15 percent of the HVI-PAO, from 0.5 to 5 percent of the second polymer comprising a block copolymer having a molecular weight from 100,000 to 1,000,000.

18. An engine oil according to claim 10 which has a viscosity grade of 0W-80 and which comprises:

from 65 to 90 percent of a basestock comprising at least one poly alpha olefin (PAO) having a viscosity from 1.5 to 6 cSt (100° C.), from 0.1 to 15 percent of the HVI-PAO, from 1 to 5 percent of the second polymer comprising a block copolymer having a molecular weight from 100,000 to 1,000,000.

19. An engine oil according to claim 10 which has a viscosity grade of 0W-90 and which comprises:

from 65 to 90 percent of a basestock comprising at least one poly alpha olefin (PAO) having a viscosity from 1.5 to 6 cSt (100° C.), from 0. 1 to 15 percent of the HVI-PAO from 1.5 to 5 percent of the second polymer comprising a block copolymer having a molecular weight from 100,000 to 1,000,000.

20. An engine oil according to claim 10 which has a viscosity grade of 0W-100 and which comprises:

from 65 to 90 percent of a basestock comprising at least one poly alpha olefin (PAO) having a viscosity from 1.5to 6 cSt (100° C.), from 0. 1 to 15 percent of the HVI-PAO from 2 to 5 percent of the second polymer comprising a block copolymer having a molecular weight from 100,000 to 1,000,000.

21. An engine oil according to claim 10 which has a low temperature viscosity grade of SW and a high temperature viscosity grade of at least 50 and which comprises:

from 55 to 70 percent of a basestock comprising at least one poly alpha olefin (PAO) having a viscosity from 1.5 to 8 cSt (100° C.), from 0. 1 to 20 percent of the HVI-PAO from 0.1 to 5 percent of the second polymer comprising a block copolymer having a molecular weight from 100,000 to 1,000,000.

22. An engine oil according to claim 10 which has a low temperature viscosity grade of l0W and a high-temperature viscosity grade of at least 60 and which comprises:

from 55 to 70 percent of a basestock comprising at least one poly alpha olefin (PAO) having a viscosity from 1.5 to 10 cSt (100° C.), from 0.1 to 20 percent of the HVI-PAO from 0.1 to 5 percent of the second polymer comprising a block copolymer having a molecular weight from 100,000 to 1,000,000.

23. A lubricant according to claim 1 which has a value for maximum air entrained at 1.0 minutes (ASTM D3427) of less than 3%.

24. A lubricant according to claim 1, wherein the lubricant is an engine oil having improved wear protection properties, and the basestock is a liquid lubricant API Group III basestock which comprises a hydroisomerized wax, a first polymer and a second polymer of differing molecular weights being blended into the liquid lubricant basestock.

25. An engine oil according to claim 1 in which the second polymer is selected from at least one member from the group consisting of hydrogenated-styrene-isoprene copolymers, ethylene/propylene (co)polymers, polyisobutylene, acrylate esters, and methacylates esters.

26. An engine oil according to claim 6 which has a Pass rating in the ASTM Sequence V-E Test (ASTM D5302-00a), which comprises:

from 50 to 90 percent of the basestock, wherein the HVI-PAO has a viscosity from 40 to 1000 cSt (100° C.), and wherein the second high molecular weight polymer comprises a block copolymer having a molecular weight from 100,000 to 1,000,000.

27. An engine oil according to claim 6 of improved air release properties (ASTM D 3427) in which the HVI-PAO has a viscosity form 1,000 to 3,000 cSt (100C).

28. An engine oil according to claim 26 in which the high molecular weight polymer comprises a linear block copolymer.

29. An engine oil according to claim 27 in which the high molecular weight polymer comprises a linear block copolymer.

30. A lubricant according to claim 1 wherein the lubricant is an engine oil.

31. An engine oil according to claim 30 having improved wear protection properties and improved viscoelastic film thickness which comprises:

a liquid mineral oil basestock having a viscosity from 1.5 to 12 cSt (100° C.) and a viscosity index of at least 110, a first polymer and a second polymer of differing molecular weights blended into the liquid lubricant basestock, the first polymer (HVI-PAO) comprising a polymer having a viscosity from 20 to 3000 cSt and a lower molecular weight than the second polymer, produced by the polymerization of an alpha olefin in the presence of a reduced metal catalyst and possessing a higher viscoelasticity than the second polymer, the second, high molecular weight polymer having viscosity thickening properties when blended with the liquid basestock.

32. A mineral oil engine oil according to claim 31 in which the mineral oil basestock comprises an API Group III mineral oil basestock having a VI of at least 120.

33. A mineral oil engine oil according to claim 32 in which the mineral oil basestock comprises a hydroisomerized wax.

34. An engine oil according to claim 30 which has a Pass rating in the ASTM Sequence V-E Test (ASTM D5302-00a), which comprises:

from 50 to 90 percent of the basestock, from 0.1 to 20 percent of the HVI-PAO which has a viscosity from 40 to 1000 cSt (100° C.), from 0.1 to 5 percent of the second high molecular weight polymer comprising a block copolymer having a molecular weight from 100,000 to 1,000,000.

35. A lubricant according to claim 1, wherein the lubricant is an engine oil having improved wear protection properties, and the basestock is a liquid lubricant basestock which comprises a hydroisomerized Fischer Tropsch wax, the first polymer and a second polymer of differing molecular weights being blended into the liquid lubricant basestock.

36. An engine oil according to claim 34 in which the high molecular weight polymer comprises a linear block copolymer.

37. An engine oil according to claim 24 which has a Pass rating in the ASTM Sequence V–E Test (ASTM D5302–00a), which comprises:

from 50 to 90 percent of the basestock, from 0.1 to 20 percent of the HVI–PAO which has a viscosity from 40 to 1000 cSt (100° C.), from 0.1 to 5 percent of the second high molecular weight polymer comprising a block compolymer having a molecular weight from 100,000 to 1,000,000.

38. An engine oil according to claim 2 which has a value for maximum air entrained at 1.0 minutes (ASTM D3427) of less than 3%.

39. An engine oil according to claim 24 of improved air release properties (ASTM D 3427) in which the HVI–PAO has a viscosity form 1,000 to 3,000 cSt (100C).

40. An engine oil according to claim 24 in which the high molecular weight polymer comprises a linear block copolymer.

41. An engine oil according to claim 24 which has a value for maximum air entrained at 1.0 minutes (ASTM D3427) of less than 3%.

* * * * *